US007570238B2

(12) United States Patent
Van Dyke

(10) Patent No.: US 7,570,238 B2
(45) Date of Patent: Aug. 4, 2009

(54) SYSTEM AND METHOD FOR REDUCING POWER CONSUMPTION BY A DISPLAY CONTROLLER

(75) Inventor: Phil Van Dyke, Surrey (CA)

(73) Assignee: Seiko Epson Corporation, Tokyo (JP)

( * ) Notice: Subject to any disclaimer, the term of this patent is extended or adjusted under 35 U.S.C. 154(b) by 820 days.

(21) Appl. No.: 10/815,317

(22) Filed: Apr. 1, 2004

(65) Prior Publication Data

US 2005/0219174 A1 Oct. 6, 2005

(51) Int. Cl.
*G09G 3/36* (2006.01)

(52) U.S. Cl. ..... 345/87

(58) Field of Classification Search ..... 345/98, 345/690, 87, 100, 204, 89, 92–93, 99, 213, 345/214, 589; 348/489, 511, 516
See application file for complete search history.

(56) References Cited

U.S. PATENT DOCUMENTS 5,408,252 A * 4/1995 Oki et al. ..... 345/205
5,650,844 A * 7/1997 Aoki et al. ..... 356/237.2
5,991,883 A 11/1999 Atkinson
6,201,522 B1 3/2001 Erhart et al.
6,323,849 B1 11/2001 He et al.
6,326,980 B1 * 12/2001 Worley, III ..... 345/691
6,480,230 B1 * 11/2002 Honma ..... 348/443
6,518,945 B1 * 2/2003 Pinkham ..... 345/92
6,529,181 B2 3/2003 Nakano et al.
6,967,687 B1 * 11/2005 Suga ..... 348/441
7,200,247 B2 * 4/2007 Ohba ..... 382/103

* cited by examiner

*Primary Examiner*—Abbas I Abdulselam

(57) ABSTRACT

A display controller and method for reducing power consumption of an electro-optical image display while still providing a useful display. A source of a set of image data words corresponding to individual pixels of an image is provided. A control circuit is adapted to substitute for a selected subset of the set of image data words the image data words from one or more contiguous pixels and to provide the resulting modified set of image data words to an output port to be made available to the electro-optical image display. The method provides a set of image data words corresponding to individual pixels of an image, substitutes for a selected subset of the set of image data words the image data words from one or more contiguous pixels, and makes available to the electro-optical image display the modified set of data words resulting from the substitution.

6 Claims, 2 Drawing Sheets

SYSTEM AND METHOD FOR REDUCING POWER CONSUMPTION BY A DISPLAY CONTROLLER

BACKGROUND OF THE INVENTION

The present invention relates to display controllers for electro-optic image displays, and particularly to such controllers having power saving features.

The electronic drive circuits that control electro-optic image displays in digital image display systems, such as liquid crystal displays ("LCDs"), consume significant power to maintain and continuously update the display. These circuits, known as display controllers, typically send both digitized image data and control signals to the electro-optic image display. Such displays commonly operate in one of two modes: full display, in which an image is displayed and updated, and display blank, in which a blank black or white screen is displayed. In full display mode all the data signals and control signals to the LCD toggle, which produces maximum power consumption by the display controller. In display blank mode only the control signals to the LCD are toggled, resulting in a black or white image on the display and minimum power consumption by the display controller.

There are situations where power savings in digital image display systems is particularly desirable. That is the case, for example, in portable computers that operate off battery power. While image blank mode can be used to save power when there is no need to see an image, often there is a need, or at least an advantage, to be able to observe an image even if the image is not the center of activity or attention. Accordingly, it would be useful to be able to reduce display controller power consumption without eliminating the image.

SUMMARY OF THE INVENTION

The present invention addresses the foregoing by providing a display controller for reducing power consumption of an electro-optical image display while still providing a useful display. The display controller comprises a source of a set of image data words corresponding to individual pixels of an image; an output port for making available to the electro-optical image display a modified set of image data words corresponding to individual pixels of the electro-optical image display; and a mode control circuit adapted to substitute for a selected subset of the set of image data words the image data words from one or more contiguous pixels and to provide the resulting modified set of image data words to the output port to be made available to the electro-optical image display.

The invention also provides a method for reducing power consumption of an electro-optical image display while still producing a useful display. The method comprises providing a set of image data words corresponding to individual pixels of an image; substituting for a selected subset of the set of image data words the image data words from one or more contiguous pixels; and making available to the electro-optical image display the modified set of data words resulting from the substitution.

It is to be understood that this summary is provided as a means of generally determining what follows in the drawings and detailed description of the invention and is not intended to limit the scope of the invention. Moreover, the objects, features and advantages of the invention will be more fully understood upon consideration of the following detailed description of the invention taken in conjunction with the accompanying drawings.

BRIEF DESCRIPTION OF THE DRAWINGS

FIG. 1(*b*) is the data in the set of FIG. 1(*a*) as sent by a display controller according to the present invention in full display mode.

FIG. 1(*c*) is the data in the set of FIG. 1(*a*) as sent by a display controller according to the present invention in one-half display mode.

FIG. 1(*d*) is the data in the set of FIG. 1(*a*) as sent by a display controller according to the present invention in one-quarter-display mode.

FIG. 1(*e*) is the data in the set of FIG. 1(*a*) as sent by a display controller according to the present invention in display blank mode.

DETAILED DESCRIPTION OF THE INVENTION

The present invention is described in connection with one preferred embodiment; however, it is to be understood that the invention is not intended to be limited to the described embodiment. It is intended to cover all alternatives, equivalents and modifications of the invention as defined by the claims herein.

The present invention takes advantage of the observation that there often are circumstances under which it would be desirable to see the current image being generated by a digital display system, but that the quality of the image is not as important as under other circumstances when the display is the focus of attention. Based on this insight, it has been determined that power savings can be achieved at the expense of displayed image resolution when the highest quality image display is not needed, yet a blank screen would be disadvantageous.

A portion of the data set for a digital image is shown in FIG. 1(*a*), specifically a set of sixteen data words corresponding to contiguous individual pixels of the image. It is to be understood that the image could have any practical number of pixels, and corresponding data words, in one or two dimensions, though this description contemplates a two dimensional image such as would be generated and displayed by a personal computer system. While most images would ordinarily comprise as many as 76,800 pixels, and corresponding data words, the exemplary set of sixteen distinct data words, corresponding to pixels 0 through 16 of an image to be displayed, is used herein solely for the sake of simplification and clarity. The original image to which these data words correspond is typically stored in the electronic memory of a digital display system and periodically updated with new data.

Figure 1A:
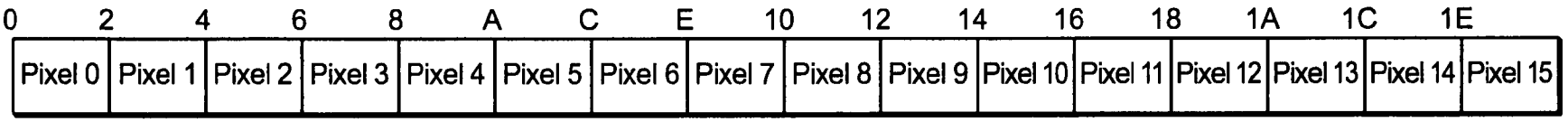
FIG. 1(*a*) is a set of sixteen data words corresponding to contiguous individual pixels of an electronic image.
Figure 1B:
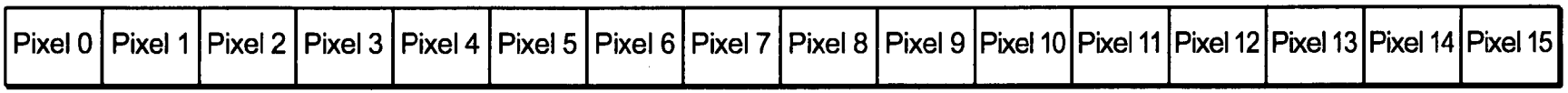
Figure 1C:
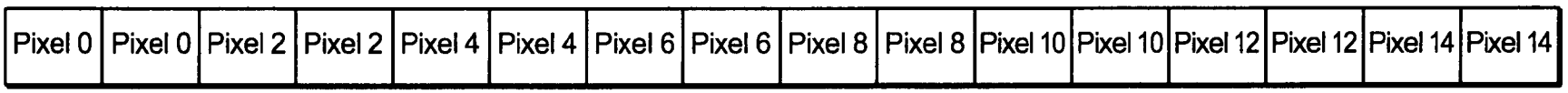
Figure 1D:
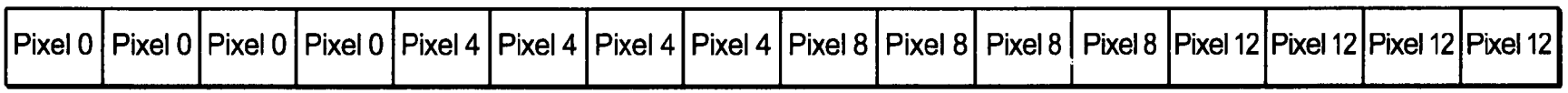
Figure 1E:
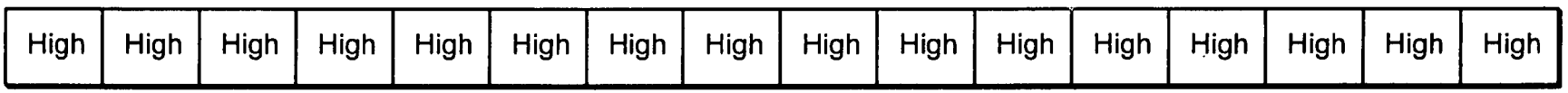
Figure 2:
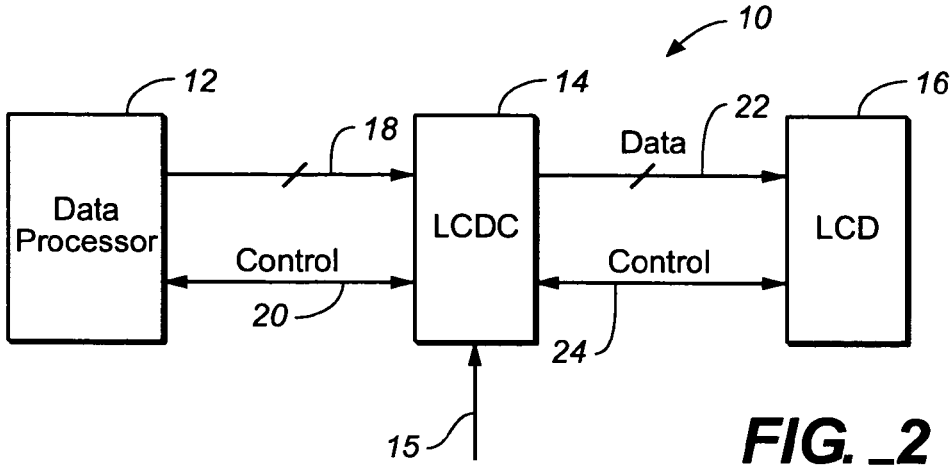
FIG. 2 is a block diagram of a digital imaging system according to the present invention.

FIG. 2 shows a block diagram of a typical digital image display system 10, comprising a host data processor 12, a liquid crystal display controller("LCDC") 14, and a liquid crystal display 16. While a LCD and a LCDC are shown by way of example, it is to be understood that the invention is not limited thereto and that other electro-optic display technologies may be used without departing from the principles of the invention.

The image to be displayed may be generated or otherwise provided to the display controller 14 by the data processor 12 over a data bus 18, together with control signals supplied over control lines 20. Alternatively, the image may be supplied by some other source, such as a camera, at input 15 to the display controller 14, though instructions would typically be supplied to the controller by the processor 12. Depending on the particular system, the entire image to be displayed may be provided by the processor 12 or other source to the display controller 14, or the processor may provide instructions to the display controller as to how the image is to be constructed, or some combination of both may be employed. In any case, the full image would typically be stored in the display controller. Then, when the full image is to be displayed, all of the data words, corresponding to all of the pixels of the full image, are sent over data lines 22 to the LCD 16, along with control signals sent on control lines 24, as shown in abbreviated fashion by the sixteen data words of FIG. 1(*b*)

In the present invention fewer than all the data words may actually be displayed. In particular, the display controller 14 may substitute for a selected subset of the full set of image data words the image data words from one or more contiguous pixels and provide the resulting modified set of image data words to the electro-optical image display. Thus, a one-half mode display may be produced, as illustrated by FIG. 1(*c*), wherein every other data word is assigned the same value as its predecessor. Similarly, as illustrated in FIG. 1(*d*), three contiguous data words are set to the value of the data word preceding them so as to produce a one-quarter-mode display. The invention also allows for a display blank mode, as illustrated by FIG. 1(*e*). In general, any of many fractional display modes may be produced by the invention in the same way. When such a fractional display mode is used, display data signal toggling is reduced and power is therefore saved.

Figure 3:
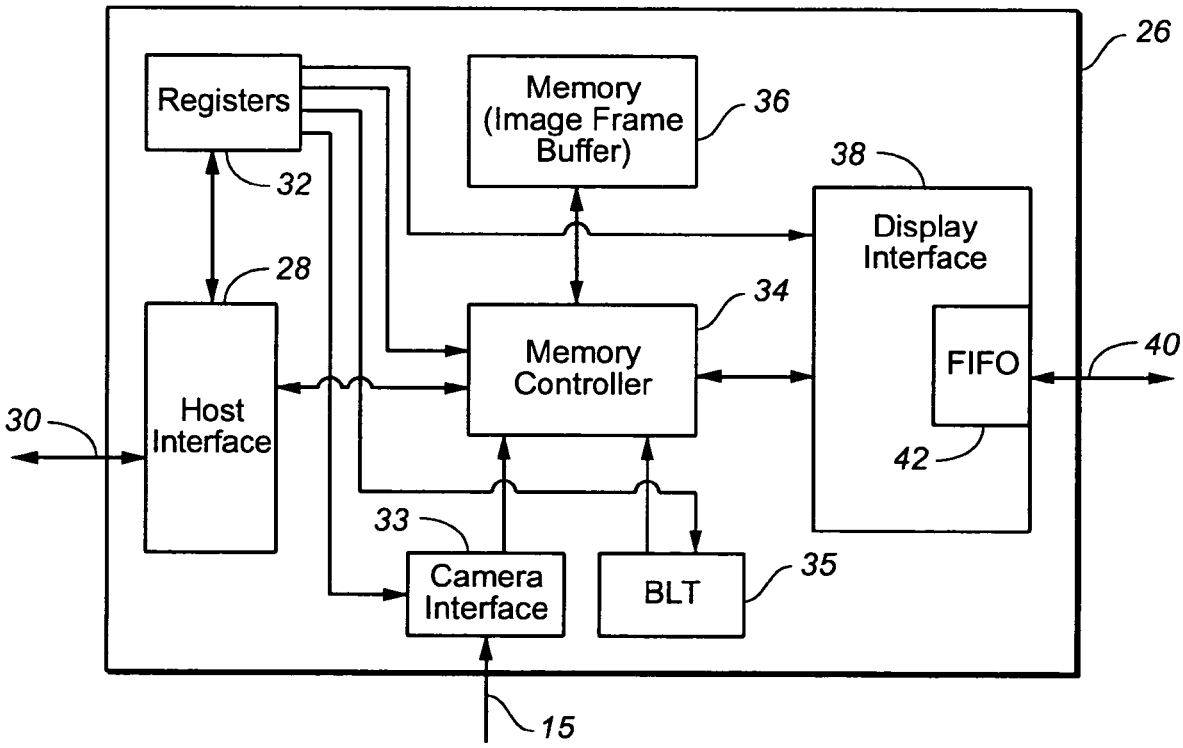
FIG. 3 is a block diagram of a display controller according to the present invention.

A display controller 26 according to the present invention is shown in FIG. 3. It comprises a host interface 28, having a host input port 30; storage registers 32 that communicate with the host interface and other components of the display controller; a camera interface 33, having an input port 15; a block transfer module("BLT") 35 for generating certain graphics functions; a memory controller 34 that communicates with the host interface, camera interface and BLT; an image memory 36 that communicates with the memory controller; and an electro-optic display interface 38, having an output port 40. Preferably, the display interface includes a first-in-first-out("FIFO") buffer 42 to send data to the output port. The host interface, camera interface, BLT, memory controller and display interface may all receive instructions from codes placed in the registers 32. In addition, the memory controller receives write addresses and image data from the host interface, camera interface and BLT, and read addresses from the display interface.

The host input port 30 provides a communications channel between a host data processor and the host interface 28 within the controller 26. Ordinarily, this communications channel would include a data bus 18 and control lines 20, as shown in FIG. 2, but other specific communications structures may be used without departing from the principles of the invention. The host interface 28 receives image data, or instructions for constructing image data, from the host input port and makes that data available to the rest of the controller 26. Alternatively, the image data may be provided to the display controller 12 by a camera through camera input port 15 to the camera interface 35; instructions for using that data are preferably provided by a host data processor, but other sources of instructions might be employed without departing from the principles of the invention. The BLT 35, or other modules that may be included in the display controller, may produce graphics elements for storage in the image memory in accordance with instructions from the host processor.

The principle function of the memory controller 34 within the display controller is to arbitrate access to the memory. It stores image data in, and retrieves image data from, the display controller memory 36. In doing so, it makes sure that no two data sources, such as the host processor and a camera, or a camera and the BLT, write data to the same location in memory at the same time. The image memory 36 preferably is a random access memory device having 16 bit-per-pixel color depth, though some other data word size, such as 8 bit-per-pixel color depth, may be used without departing from the principles of the invention.

To implement the display modes described above, the memory controller 34 is adapted first to store a full set of image data in the image memory 36, then to retrieve that data selectively in response to the display interface 38. The display interface includes a mode control circuit that requests the data according to the display mode selected by the user. The display interface also receives image data words from the memory controller 34 and makes them available to an electro-optic display at the output port 40. The FIFO 42 of the display interface provides the data words at the output port as parallel-bit data words; however, it is to be understood that either serial or parallel data communications between the display controller and a host processor, a camera or the electro-optic display may be employed without departing from the principles of the invention.

In the case of full display mode, all of the pixel data are retrieved and provided to the display interface 38, which preferably sends them to the electro-optic display as shown by FIG. 1(*b*). In display blank mode, the memory controller 34 is not requested to retrieve any data; rather, the display interface simply provides a maximum "high" or a minimum "low" to the display for all pixels. In all other cases, the display interface implements pixel duplication to provide a display of lower quality in favor of reduced power consumption.

Thus, in the case of one-half display mode, the display interface requests that only every other pixel data word be read from the memory 36, and the data lines of the output port 40 are held constant for two pixels, which reduces data toggling by one-half and produces a concomitant reduction in power consumption. Similarly, in the case of one-quarter display mode, only every fourth pixel data word is read from memory and the data lines of the output port are held constant for four pixels, which reduces the data toggling by one quarter and produces a concomitant reduction in power consumption. Generally, any fractional display may be produced using the same scheme to reduce power consumption at the cost of display quality.

It has been found that for typical real images, such as those that are generated by a camera interface or a JPEG file, the one-half mode results in very little noticeable image quality reduction. Significantly more image quality reduction results from one-quarter display mode, but substantial power savings is also achieved. The following table shows the power consumption of a representative display controller according to the present invention for several display modes.

TABLE 1

| | Full Display Mode | One Half Display Mode | One Quarter Display Mode | Display Blank Mode |
|---|---|---|---|---|
| Power Consumption | 8.7 mA (milliamperes) | 6.1 mA | 4.6 mA | 2.7 mA |

Thus, it can be seen that a 47% power savings can be achieved in one-quarter display mode, which is often worth the degradation in image quality. Indeed, the savings from display blank mode is only 22% more, yet no useful information is displayed.

The terms and expressions which have been employed in the foregoing specification are used therein as terms of description and not of limitation, and there is no intention, in the use of such terms and expressions, to exclude equivalents of the features shown and described or portions thereof, it being recognized that the scope of the invention is defined and limited only by the claims which follow.

The invention claimed is:

1. A method for reducing power consumption, comprising:

producing an electrical representation of an image, wherein a resolution of the image is equivalent to the resolution of a display, and the apparent resolution of the image is a first fraction of the resolution of the display, wherein the first fraction is a ratio of the apparent resolution of the image divided by the resolution of the display; and producing an output, in which a data line is held constant for a period of time that is equivalent to a multiple of an inverse of the first fraction and a period of time required to transmit data representing a single pixel, wherein power consumption is reduced by reducing data toggling on the data line by the first fraction.

2. The method of claim 1 further comprising retrieving from memory a selective first fraction of data stored in memory that is an electrical representation of the image.

3. The method of claim 1, wherein the output is parallel-bit data words, each data word representing a single pixel, each bit of the data word is held constant for a period of time that is equivalent to a multiple of the inverse of the first fraction and the period of time required to transmit a single data word.

4. A display controller for performing the method of claim 1.

5. A digital image display system for performing the method of claim 1 including the display.

6. The digital image display system of claim 5 wherein the display is an electro-optic display and circuitry performs the method.

* * * * *